United States Patent [19]

Stenzel

[11] 4,397,618

[45] Aug. 9, 1983

[54] ROLLING PISTON COMPRESSOR WITH LOCKING DEVICE FOR THE SEPARATING SLIDE

[75] Inventor: Adalbert Stenzel, Stuttgart, Fed. Rep. of Germany

[73] Assignee: Bitzer-Kuhlmaschinenbau GmbH & Co. KG, Fed. Rep. of Germany

[21] Appl. No.: 208,639

[22] Filed: Nov. 20, 1980

[30] Foreign Application Priority Data

Nov. 21, 1979 [DE] Fed. Rep. of Germany ..... 2946906

[51] Int. Cl.[3] ..... F04C 18/00; F04C 29/10; F04B 49/02

[52] U.S. Cl. ..... 418/23; 418/63; 417/283

[58] Field of Search ..... 417/283, 284, 310; 418/23, 63

[56] References Cited

U.S. PATENT DOCUMENTS 3,904,321 9/1975 Rüedi et al. ..... 417/283

FOREIGN PATENT DOCUMENTS 981898 5/1951 France .
52-43107 4/1977 Japan ..... 417/283
55-66693 5/1980 Japan ..... 418/23

OTHER PUBLICATIONS

Annual Report of BMFT 1978 (Research Project ET 5079A), pp. 442–447.
Rüedi; Joseph "A New Rolling Compressor from Switzerland" published in Thema des Monats-Technik in Kr 10/74.

*Primary Examiner*—John J. Vrablik
*Assistant Examiner*—Timothy S. Thorpe
*Attorney, Agent, or Firm*—Kenway & Jenney

[57] ABSTRACT

A rolling piston compressor comprising: a casing of circular cross-section; a rolling piston supported within the casing on a drivable eccentric shaft so as to be freely rotatable thereon and adapted to roll on the internal surface of the casing in the course of rotation of the shaft; at least one separating slide slidably supported in the casing and resiliently urged by the action of a spring against the circumference of the rolling piston, said slide being disposed between an inlet port for drawing in a medium which is to be compressed and an outlet port for the delivery of the compressed medium, and being associated with a device for locking the separating slide in a position in which the free edge does not bear on the rolling piston circumference.

7 Claims, 5 Drawing Figures

ROLLING PISTON COMPRESSOR WITH LOCKING DEVICE FOR THE SEPARATING SLIDE

This invention relates to rolling piston compressors. Such compressors conventionally comprise a casing of circular cross-section, a rolling piston supported within the casing on a drivable eccentric shaft so as to be freely rotatable thereon and adapted to roll on the inside surface of the casing when the shaft rotates, and at least one separating slide, which is slidably supported in the casing and resiliently urged by a spring a spring against the circumference of the rolling piston. This slide is disposed between an inlet port for drawing in a medium which is to be compressed and an outlet port for the delivery of the compressed medium and is associated with a device for locking the separating slide in a position in which the free edge does not bear on the rolling piston circumference, at least during one part of the rolling piston motion. The locking device has a bolt, which is slidable transversely to a guide for the separating slide between a first position, in which it releases the separating slide, and a second position in which it fixes the separating slide in the position in which it is raised from the rolling piston.

It is already known that the output of a rolling piston compressor can be influenced if the slidably supported separating slide, which separates the space between the rolling piston and the casing, is locked in a position which is remote from the rolling piston. In rolling piston compressors of the kind hereinbefore described this results in a short circuit, i.e. the rolling piston compressor operates under no-load (Josef Rüedi "Ein neuer Rollkompressor aus der Schweiz" (A new rolling compressor from Switzerland) published in "Thema des Monats-Technik" in Ki 10/74, pages 421 to 424).

In this system, the separating slide is fixed in its top dead centre position if the compressor is to operate under no-load conditions. A special construction by which locking of the separating slide in this position can be achieved, is not described.

Furthermore, it is known from the Annual Report of BMFT 1978 (Research Project ET 5079 A, page 442) that output control of a rolling piston compressor with a plurality of separating sides is possible if the separating slides can be retained at the top dead centre by a suitable device (for example a pneumatic or magnetic device). This literature reference also does not describe any device by means of which such locking can be achieved.

To lock the separating slide it is already known to provide a bolt which can slide perpendicularly into the part of the separating side (JP-A 2 Publication 52-43107). This bolt clamps the separating slide in the appropriate position. It is a disadvantage of this construction that, on the one hand the separating slide can be fixed in any desired position and it is therefore not possible to obtain defined fixing in the highest position of the separating slide. When being fixed in an intermediate position, rotation of the rolling piston causes the latter to strike the free end of the separating slide so that the latter is pushed into the topmost position and the bolt is thrust against the separating slide over the entire sliding travel. On the one hand, this causes the separating slide to apply large forces to the rolling piston and on the other hand it results in substantial stresses in the sliding region between the bolt and the separating slide.

A fixing element, which is rotatably supported by the casing and has as projection which grips beneath the casing (French patent specification No. 981 898) is provided in another arrangement for locking the separating slide. When this locking device is released, an operation which can occur in any phase, it is possible by virtue of the action of the accelerating spring, for the separating slide to strike against the circumference of the rolling piston and thus be damaged.

It is the object of the invention to improve a rolling piston compressor of the kind hereinbefore described so that the separating slide can be locked in a defined position and the risk of damage to the separating slide in operation is eliminated.

In a rolling piston compressor of the kind described hereinbefore, the present invention proposes that in accordance with the present invention the bolt should be constructed as a ratchet bolt which is slidable into the path of the separating slide and in this position fixes the separating slide in a position which is withdrawn from the rolling piston, the ratchet bolt then engaging beneath a support surface on the separating slide. The ratchet bolt has a support surface which is inclined in relation to its sliding direction and on which the support surface of the separating slide bears when the ratchet bolt is advanced. The angle of inclination is selected so that the separating slide is removed from the rolling piston when the ratchet bolt is advanced, a stop abutment being provided to limit the advance motion of the ratchet bolt so that in its locked position the free edge of the separating slide extends slightly into the casing.

Advantageously, the bearing surface extends substantially parallel with the support surface.

It is advantageous if the end of the support surface which is situated opposite the free end of the ratchet bolt is provided with a stop abutment which, on being advanced, bears upon the separating slide and defines the advance motion of the ratchet bolt.

In a preferred exemplified embodiment a driving device is provided for sliding the ratchet bolt. According to the preferred exemplified embodiment, this can comprise a solenoid into which an armature, fixedly connected to the ratchet bolt, is adapted to plunge. Energization of the solenoid causes the armature and the ratchet bolt, which is fixedly connected thereto, to be displaced; this can be achieved against the action of a spring which returns the ratchet bolt into its original position when the solenoid coil ceases to be energized.

It is particularly advantageous if the free edge of the separating slide in its locked position projects slightly into the casing. Due to this arrangement, the free edge of said slide bears briefly on the surface of the rolling piston during each rotation thereof and is lightly raised with respect to the ratchet bolt. In this raised position it is readily possible for the ratchet bolt to be withdrawn from the locked position, since the slide bears on the rolling piston and does not make contact with the ratchet bolt.

In a preferred embodiment the separating slide is provided with a recess of which the top edge forms the bearing surface.

The invention is hereinafter described by reference to the accompanying drawings which illustrate preferred embodiments thereof and in which.

Figure 1:
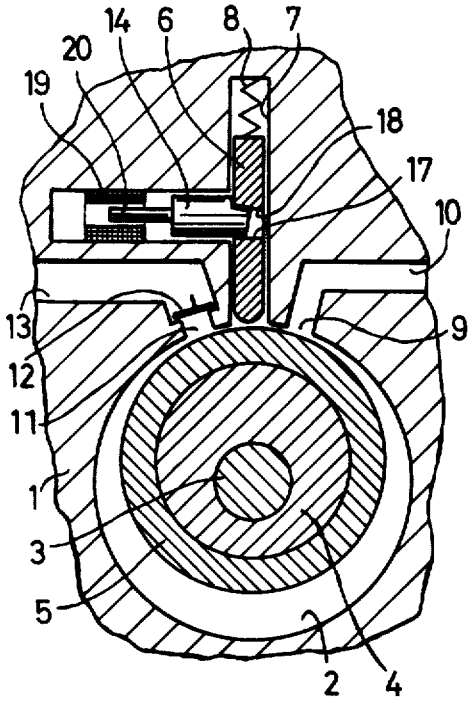
FIG. 1 is a diagrammatic cross-sectional view of a rolling piston compressor with a locking device, according to the invention, for the separating slide which is to be locked.

The construction of a known rolling piston compressor is shown in the drawng in substantially simplified form; only the parts essential for the operation of such a compressor are shown. Thus an eccentric 4, on which a rolling piston 5 is supported so as to be freely rotatable, is fixed to a drivable shaft 3, which projects concentrically into a space 2 within a circular cylindrical casing 1. Rotation of the shaft 3 causes the rolling piston 5 to roll upon the inside surface of the casing 1. A separating slide 6 is slidably supported by a guideway 7 which opens into the cavity and is disposed in the casing. This separating slide is resiliently thrust against the rolling piston 5 by a compression spring 8 which acts between the separating slide 6 and the casing 1. The space 2 communicates via an inlet port 9 with a suction duct 10 and via an outlet port 11, closed by means of a non-return valve 12, with a delivery duct 13. The inlet port 9 and the output port 11 are disposed on opposite sides of the separating slide 6 directly adjacent the guideway 7.

A ratchet bolt 14, which can be advanced into the sliding path of the separating slide 6, is supported in the casing so as to be transversely slidable relative to the guideway 7. At its end nearest the separating slide the ratchet bolt has a support surface 15 which is inclined with respect to the advance direction and extends to an abutment 16 which is substantially perpendicular to the support surface 15. The support surface 15 tapers from the stop 16 to the leading end of the ratchet bolt 14.

The separating slide 6 has an aperture 17 of which the top edge is formed as a sloping bearing surface 18 which extends substantially parallel with the support surface 15. The position of the aperture 17 and the separating slide is such that the free edge of the separating slide projects slightly into the space 2 if the bearing surface 18 of the separating slide bears on the support surface 15 of the ratchet bolt when the latter is advanced.

For causing the ratchet bolt 14 to slide, there is provided a solenoid 19, having its longitudinal axis parallel with the sliding direction of the ratchet bolt and an armature 20, fixedly connected thereto, adapted to enter the solenoid. A spring can additionally be provided to slide the ratchet bolt into one limiting position. This spring is not shown in the drawing.

Figure 2:
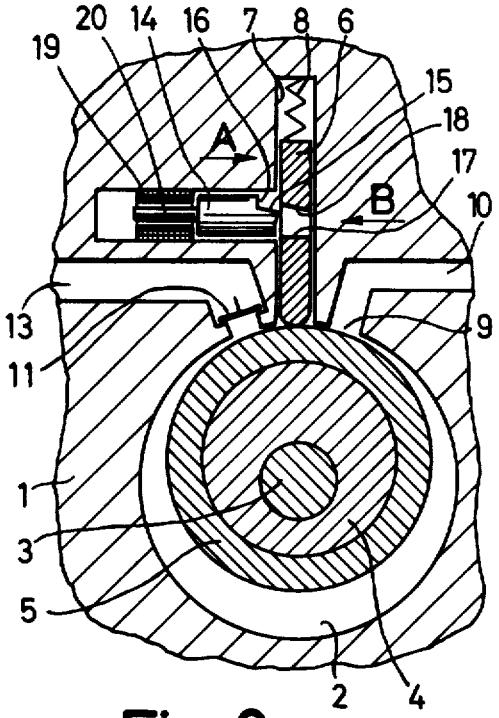
FIG. 2 is a view similar to FIG. 1, with the separating slide shown as being freely movable.
Figure 3:
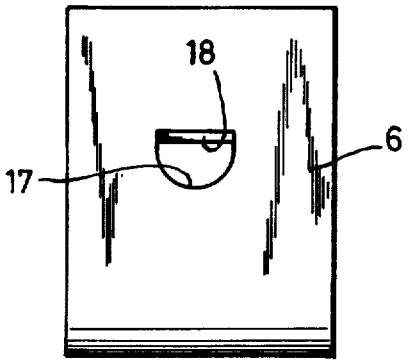
FIG. 3 is a view of the separating slide in the direction of the arrow A in FIG. 2.

In operation of the device according to the invention, the ratchet bolt is normally in the retracted position shown in FIG. 2. In this position it is possible for the separating slide to move freely under the action of the compression spring 8, so that its bottom edge bears sealingly on the circumference of the rolling piston. This is the normal operating state in which the separating side divides the suction side of the compressor from the compression side.

De-energization of the solenoid 19 enables the ratchet bolt to be advanced against the separating slide by the action of a spring, not shown in the drawing. As soon as the separating slide is raised by the motion of the rolling piston close to the top dead-centre position of the latter, the free end of the ratchet bolt will enter the aperture 17 and the support surface 15 will bear upon the bearing surface 18. Due to the action of the solenoid 19, the ratchet bolt is advanced against the separating slide until the stop abutment 16 bears on the separating side 6. Owing to the sloping construction of the support surface and of the bearing surface, such as advancing motion of the ratchet bolt is accompanied by raising of the separating slide 6. The separating slide remains fixed in this position, i.e. its bottom edge can no longer bear sealingly upon the surface of the rolling piston. The compressor will then operate under no-load conditions.

If it is desired to re-engage the separating slide, it is only necessary to energize the solenoid 19. The ratchet bolt will then again move into its starting position illustrated in FIG. 2. The sliding motion of the ratchet bolt is assisted by the fact that in its advanced position, in which the stop abutment 16 of the ratchet bolt bears upon the separating slide (FIG. 1), the bottom edge of the latter projects slightly into the cavity 2, for example by 0.2 mm. Accordingly, during its motion the rolling piston will slightly raise the separating slide, i.e. its bearing surface is separated from the support surface. At this moment it is possible for the ratchet bolt, which is now being relieved of load, to be simply retracted.

Figure 4:
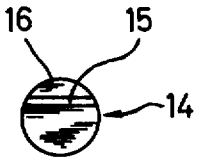
FIG. 4 is a view of the ratchet bolt in the direction of the arrow B of FIG. 2.

The ratchet bolt can have a circular cross-section, as shown in FIG. 4.

Figure 5:
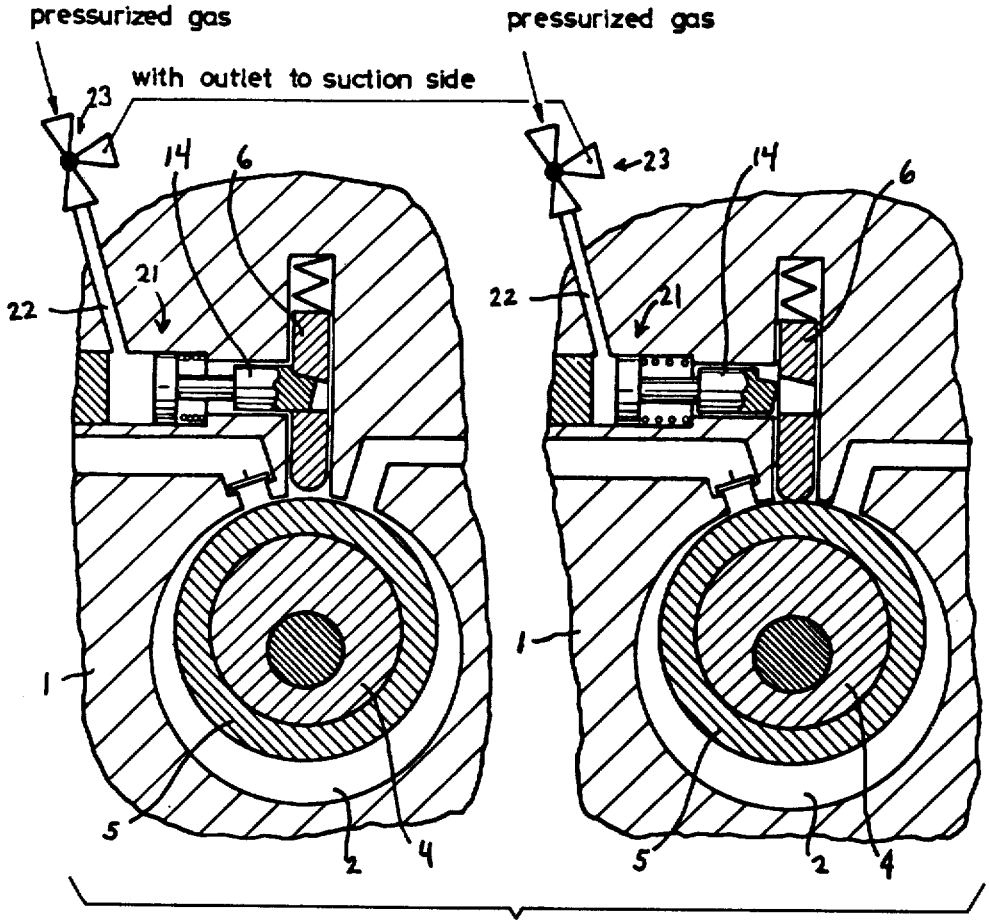
FIG. 5 is a view corresponding to FIGS. 1 and 2 of a rolling piston compressor which is the same as shown in FIGS. 1 and 2 except that a servomotor operated by the compressor gas in turn operates the ratchet bolt.

Driving the ratchet bolt by means of a solenoid system is merely one of several means which could be adopted for sliding the ratchet bolt. For example, mechanical sliding of the ratchet bolt is possible by means of a suitable slide. Also, FIG. 5 shows a pneumatic servomotor 21 which serves the same function as the solenoid 19. As shown, the servomotor is activated by a pressurized gas, that which is produced by the rolling piston compressor. A suitable passageway 22 in the casing applies the pressurized gas to one side of the servomotor. A venting valve 23 leads to the suction side of the compressor.

The locking device according to the invention is characterised by a particularly simple construction so that reliable operation is thus made possible.

The locking device described by reference to FIGS. 1 to 4 can of course be used in a rolling piston compressor with a plurality of separating slides. In this case, in order to regulate the output it is possible for the separating slides to be optionally locked in their top position or they can be freely slidable. For the purpose of no-load relief, it is advantageous initially to lock the separating slides in the top position and to release them only a short time after the compressor is brought into operation.

The sliding device of the ratchet bolt offers the advantage that when the machine is shut down and the solenoid 19 is de-energized, the ratchet bolt is moved into the latched position so that the slide can be fixed in the top dead centre position. If operation of the compressor recommences subsequently, the compressor will start under no-load conditions, since the slide will not be immediately released by the ratchet bolt. The desired no-load relief on starting is thus automatically obtained.

Another advantage of the system according to the invention is that the ratchet bolt can be moved from the lock position into the release position only if the rolling piston thrusts the slide bearing thereon briefly into the guide so that the bearing surface 18 is slightly lifted off the support surface 15. The ratchet bolt cannot be retracted from the latch position in any of the other positions of the rolling piston. Releasing of the ratchet bolt and releasing of the slide motion is therefore possible only if the bottom edge of the slide bears upon the rolling piston. This reliably avoids the action of the compression spring causing an impact of the slide upon the circumference of the rolling piston due to a sudden release and possibly an instant return into the guideway, which could result in damage to the slide and/or to the rolling piston.

In the system according to the invention the bottom edge of the slide bears upon the rolling piston and no sudden accelerations of the side occur when it is released. The construction according to the invention therefore necessarily synchronizes the release of the slide with the position of the rolling piston. It is perfectly feasible that on being initially raised by the rolling piston the slide is not yet released when the solenoid is de-energized but instead the rolling piston must raise the slide repeatedly, until the ratchet bolt is completely retracted into the release position. Nevertheless, final release always takes place in a phase in which the slide bears upon the rolling piston and is therefore already reliably guided thereby.

I claim:

1. A rolling piston compressor comprising a casing of circular cross-section having an inlet port for drawing in a medium which is to be compressed and an outlet port for the delivery of the compressed medium;

a drivable eccentric shaft;

a rolling piston supported within the casing on said drivable eccentric shaft so as to be freely rotatable thereon and adapted to roll on the internal surface of the casing in the course of rotation of the shaft;

a spring mounted in said casing;

at least one separating slide slidably supported in the casing and resiliently urged in a first direction by the action of said spring against the circumference of the rolling piston;

said slide being disposed between said inlet port and said outlet port, said slide having a bearing surface and having a free edge adjacent said rolling piston, a device for locking said separating slide in a position in which the free edge does not bear on the rolling piston circumference, at least during one part of the rolling piston motion;

said locking device including a ratchet bolt which is slidably transversely relative to said first direction between a first position, in which it releases the separating slide, and a second position in which it fixes the separating slide in the position in which it is withdrawn from the rolling piston;

said ratchet bolt having a support surface which is inclined relative to its sliding direction and on which said bearing surface of the separating slide bears when the ratchet bolt is advanced from said first position to said second position and an abutment;

said angle of inclination being selected so that said separating slide is withdrawn from the rolling piston when the said ratchet bolt is advanced;

said abutment limiting the advance motion of said ratchet bolt; and said free edge of the separating slide in said first position extending slightly into the casing.

2. A rolling piston compressor according to claim 1, wherein the bearing surface extends substantially parallel with the support surface.

3. A rolling piston compressor according to claim 1 wherein the end of the support surface situated opposite the free end of the ratchet bolt has said abutment which, on being advanced, bears upon the separating slide and limits the advance motion of the ratchet bolt.

4. A rolling piston compressor according to claim 1 and comprising a driving device for sliding the ratchet bolt.

5. A rolling piston compressor according to claim 4, wherein the driving device comprises a solenoid casing containing an armature which is fixed with the ratchet bolt.

6. A rolling piston compressor according to claim 1, wherein the separating slide is associated with a recess of which the top edge forms the bearing surface.

7. A rolling piston compressor according to claim 4, wherein the driving device is a servomotor.

* * * * *